United States Patent [19]

Chou

[11] Patent Number: 4,890,000

[45] Date of Patent: Dec. 26, 1989

[54] CONTROL CIRCUIT OF THE DECORATIVE LIGHT SETS

[76] Inventor: George Chou, No. 8-3, Lane 85, K'ang-Ling Street, Hsin-Chu Hsien, Chu-Tung Chen, Taiwan

[21] Appl. No.: 257,008

[22] Filed: Oct. 13, 1988

[51] Int. Cl.[4] ..... H05B 37/02

[52] U.S. Cl. ..... 307/36; 307/11; 307/38; 307/41; 315/185 S; 315/320; 315/323

[58] Field of Search ..... 307/11, 34, 35, 36, 307/38, 40, 41, 112, 13, 104; 315/185 R, 176, 185 S, 161, 323, 294, 320, 312; 340/825.69; 362/152

[56] References Cited

U.S. PATENT DOCUMENTS

| | | | |
|---|---|---|---|
| 3,740,570 | 6/1973 | Kaelin et al. | 307/40 |
| 3,845,615 | 11/1974 | Cake | 307/38 X |
| 4,016,474 | 4/1977 | Mason | 307/41 X |
| 4,215,277 | 7/1980 | Weiner et al. | 307/41 |
| 4,262,213 | 4/1981 | Eichelberger et al. | 307/40 |
| 4,264,845 | 4/1981 | Bednarz | 315/176 X |
| 4,284,926 | 8/1981 | Dinges | 315/312 |
| 4,388,567 | 6/1983 | Yamazaki et al. | 315/294 X |
| 4,390,814 | 6/1983 | Peek | 315/320 |
| 4,417,182 | 11/1983 | Weber | 315/323 X |
| 4,713,586 | 12/1987 | Chiang | 315/185 S X |
| 4,780,621 | 10/1988 | Bartleucci et al. | 307/11 |

*Primary Examiner*—William M. Shoop, Jr.
*Assistant Examiner*—Paul Ip
*Attorney, Agent, or Firm*—Leonard Bloom

[57] ABSTRACT

A digital control circuit for controlling the illumination of a plurality of lamp bulbs to create a decorative light display. The circuit includes a rectifier for converting alternating current to direct current as power for the digital elements of the control circuit and for the lamp bulbs of the display. The display is formed by a plurality of strings of series connected lamp bulbs each of which strings is supplied d.c. power through individual SCRs. The control circuit includes two oscillators, two decoders and a carry-out control which generate two different sequences of output signals at two different frequencies. The two sequences of output signals from the control circuit are each applied through isolating diodes and individual trigger circuits to the gate electrodes of the SCRs, causing the SCRs to conduct and illuminate each of the strings of lamps in sequences corresponding to the sequences of control circuit output signals.

1 Claim, 2 Drawing Sheets

CONTROL CIRCUIT OF THE DECORATIVE LIGHT SETS

BACKGROUND OF THE INVENTION

This invention provides one kind of control circuit system of the decorative light sets, especially point out that utilize two kind of mutually circulated controlling out-put of signal, so that let the decorative light sets have a continuous and pursuing regularly, reversible twinkling action of control circuit, said control circuit has provided one executive control in order to make system control of first, second decoding means, due to the logic transfer of output of executive control is quick, stable, so that the whole electric control system be able to increase more stability of decorative light action, the decorative light sets have established series connection planning, depend on how much of consuming power factor of decorative light sets and change the number of series connection, coordinate with the variety of series connection design to diversify its pursuing regularity, reversible twinkling so that it will have more increasing of peoples attraction. In recent year, the industry and commerce have rapid development, and lead the whole economical activity, especially in business world, the trade is become more active, therefore due to the commercial means is renew, break through continuously, so the competitive press is getting more and more serious, therefore, how to attract people's attention effectively, this is already fixed as a more important theme in the market place. In former times, it is mostly adopted big signboard or refreshing neon lamp advertisement in the ordinary market place to attract the attention of customers, in recent years, it is used to be utilized the street trees and hanging the decorative light sets on the trees of both side walk of street, it is not only beautiful and dignified and more saving electricity than neon light, it is extremely ideal, however a conventional decorative light sets are mostly adopted the mother lamp which is produced light up and turn off the lights in order to form an irregular twinkle effect of whole series of decorative light sets, like this, it is only forming a simple light up and turn off twinkle of whole decorative light sets and can't reach to regularly, plurality of twinkle effect, it is really to need some improvement, applicant has considered the several defect of conventional decorative light sets also study very hard, in addition to many years of fabrication and design experiences, after study and research, finally I have accomplished this invention.

SUMMARY OF THE INVENTION

The object of this invention provides one kind of utilizing the executive control in the electric control circuit which is made system control of the two decoding means, in order to have the decorative light sets done continuously and pursing of regularity, reversible of twinkle action of the control circuit system of decorative light sets.

Another object of this invention provides one kind of the decorative light sets which are settle an electric control system of plurality of twinkle of decorative light sets.

Regarding to this invention, we have adopted technique, parts, means, in order to reach to the above mentioned object and other objects, here we will take relatively better, concrete example to explain in coordimate with drawings, so as to have the examiner to get understanding easily.

DESCRIPTION OF THE PREFERRED EMBODIMENT

The electric control system of the decorative light sets of this invention shows as one control system of decorative light sets and is consisted of electric control circuit of continuous and regularity of twinkling 1 and several groups of decorative light set 2 are connected as series, the detail explanation as follows.

Figure 1:
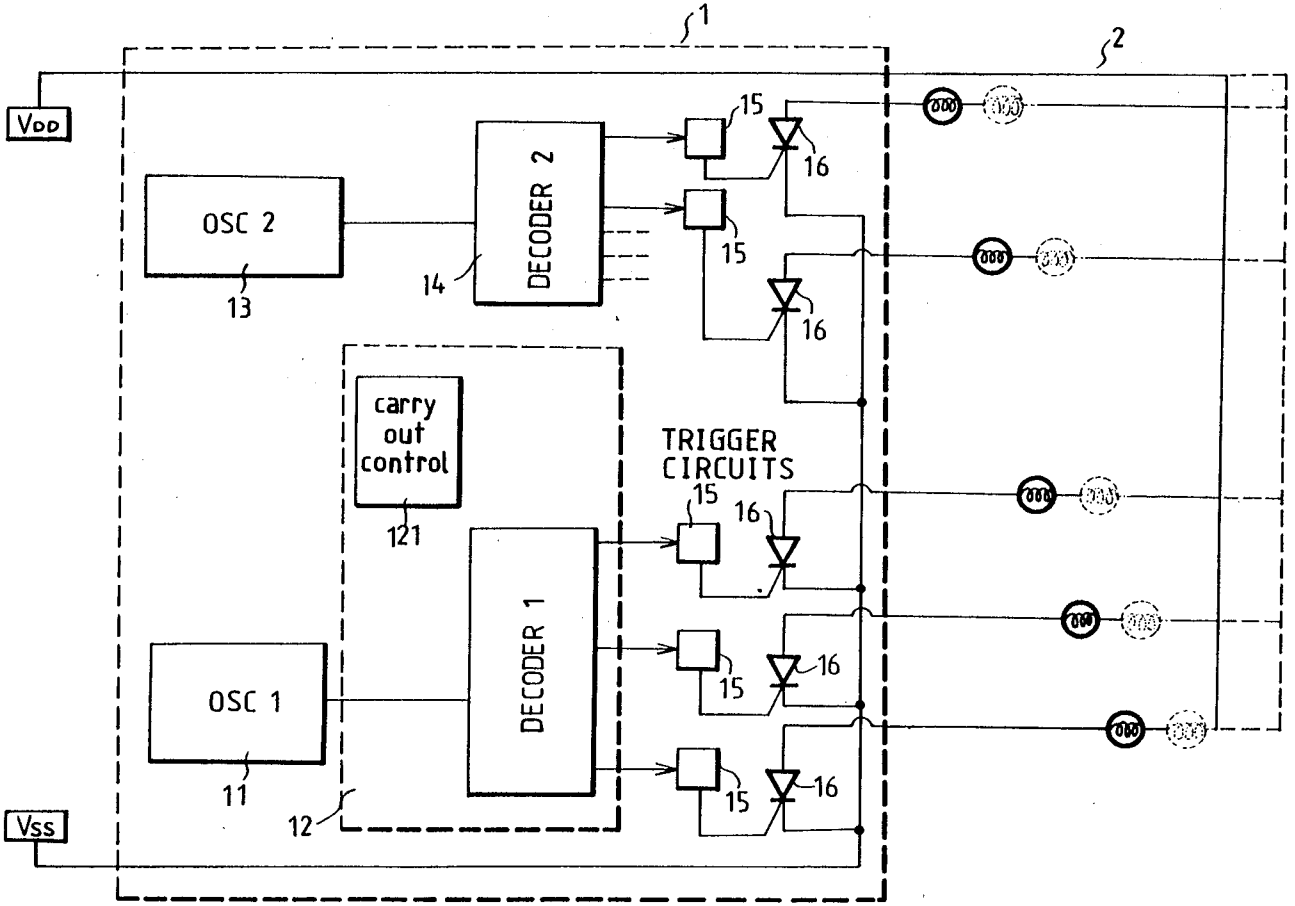
FIG. 1 is a block diagram of this invention.
Figure 2:
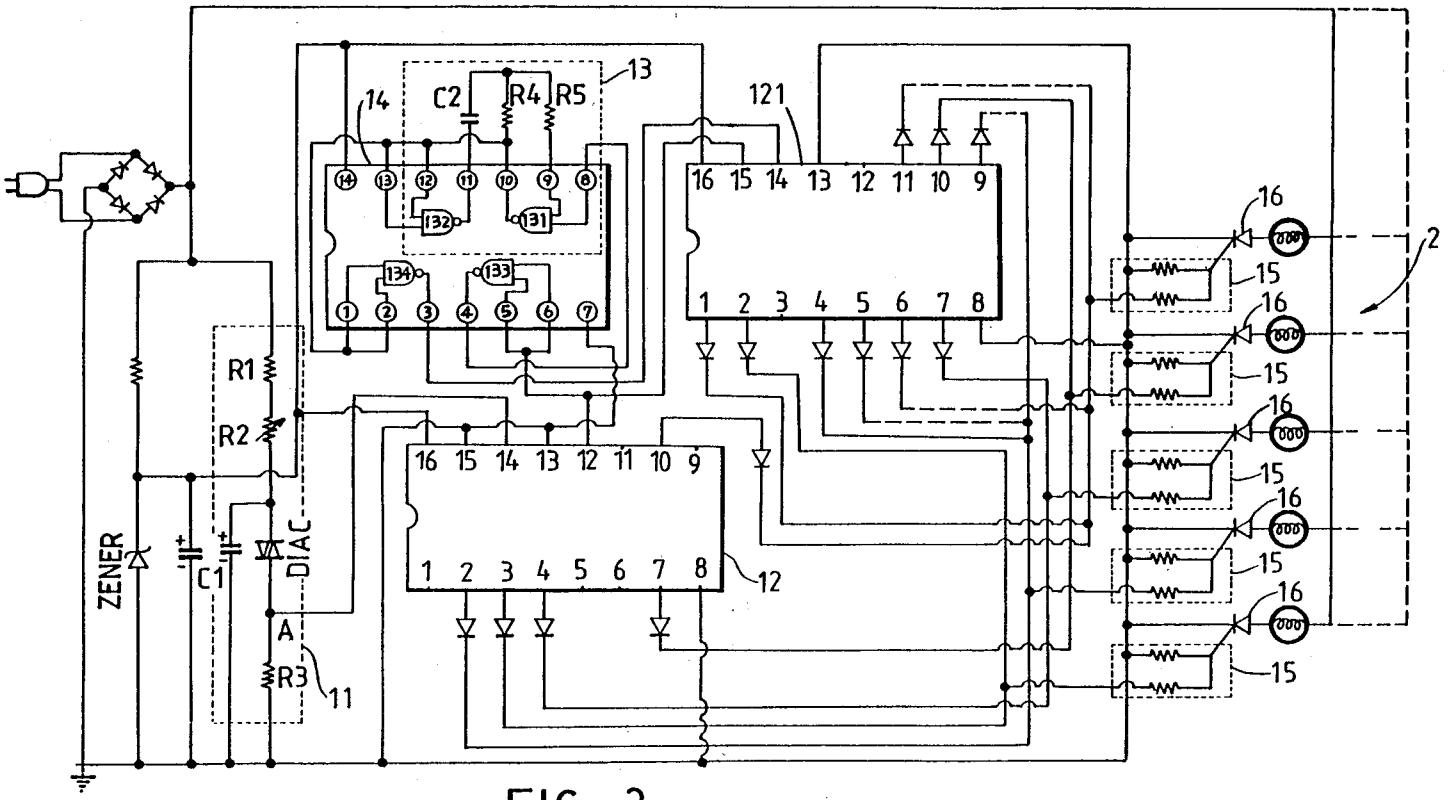
FIG. 2 is a detail electric circuit of this invention.

Please to refer to FIG. 1, the electric control circuit 1 of this invention is consisted of first oscillating means 11, first decoding means 12, second oscillating means 13, second decoding means 14, trigger circuit 15 and switch control means 16, among them, it is still provided an executive control 121 of the inside of the first decoding means so as to control first or second decoding means sending output of trigger means 15, also let supply electricity to switch control means 16, at the same time the decorative light sets 2 are forming conducted loop circuit also work continuous and regularity of twinkling, we will try to narrate in complete detail of their working principle in cooperation with the complete electric control circuit FIG. 2 as follows.

Please refer to FIG. 2, input electric source becomes two branch circuits after rectifying, one of them is connected to the decorative light sets 2 as working source of decorative light sets; another branch circuit also devide into two circuits, one branch circuit is passing through ZENER diode after, said voltage become stabilized and supply working source to all of electric eircuits, another branch circuit is passing through first oscillating means (OSCI) 11, and energize from A point to clock end of first decoding means (DECODER 1), said oscillating means 11 is consisted or R1, R2, R3, C1 and DIAC, at the same time produces a stable working frequency, among them R2 is variable resistor, if you change its resistance it means changing the out-put frequency of first decoding means, assume that first decoding means 12 has worked, the out-put of decoding means passing through trigger circuit 15 which is connected in series, at the same time produce a trigger signal to gate terminal (G) of switch control means (SCR) 16, due to the anode pole (A) of SCR is connected which pass through decorative light sets to source VDD and cathode pole (K) is connected to VSS, therefore it is conducted by trigger means, and the decorative light sets located in this loop circuit and depended upon decoding out-put of first decoding means start to work continuous and regularity of twinkling. Assume that executive control 121 of first decoding means start to work, and order first decoding means 12 to cut off the circuit, said second oscillating means (OSC 2) 13 start to work in cooperation with second decoding means, among them, second oscillating means is consisted of R4, R5, C2 and NAND gate 131, 132, at the same time, produce a stable working frequency, said in-put is consisted of the out-put of executive control of first decoding means through NAND gate 133 in cooperation with feedback resistor R5, said out-put pass through NAND gate 134, and connect to clock end of second decoding means, assume that second decoding means start to work, said out-put of the second decoding means passing through trigger circuit 15 connected in series, at the same time, produce a trigger signal which is sent to switch control means 16, then the said switch control means conducts electricity at once and energize on the decorative light sets which is located on the loop circuit, and depend on the out-put of second decoding means start to work continuous and regularity of twinkling.

Assume that the executive control signal stop to work, then order second decoding means stop to work, and also first decoding means start to work, it is circulated work each other like the above mention manner, the decorative light sets become a continuous and regular twinkling action. Like the above mentioned, two sets of oscillating means of this invention has produced working frequency respectively, then transmit to first, second decoding means, among them, it is provided an executive control in first decoding means, assume that first decoding means start to work and the same time order second decoding means stop to work, said out-put of first decoding means order trigger circuit to provide one trigger signal to switch control means 16, it means sending to gate pole of SCR, at the same time the cathode pole of SCR is connected to VSS, and anode pole pass through decorative light sets then connect to VDD, therefore SCR has conducted and the same time, the decorative light sets also get through the circuit and light up, among them, said SCR stop to work, utilizing the potential is zero, therefore the decorative light sets are forming rapid twinkling action at once; assume that, the executive control of first decoding means start to work, and order first decoding means stop to work, at the same time, second decoding means start to work and the out-put signal of decoding means order trigger circuit to provide one trigger signal to switch control means 16, then said switch control means get through the circuit, and decorative light sets located between said switch control means 16 and VDD also forming conduct and light up, also to do the rapid twinkling action, suppose that the executive control stop to work, and recover the action of first decoding means and second decoding means stop to work, the transfer of said action of two systems between 12 and 14 are decided by said executive control 121, then due to the transfer of the control of logic of the said executive control is quick, stable, therefore the whole decorative light sets are able to do the stable change of continuous and regular twinkling. The decorative light sets are connected between VDD and switch control means, it adopted one general lamps sets and improved C7C9 type of lamps are combined together and forming the decorative light sets, therefore we will be able to change the number of decorative light sets according to its consuming power factor, at the same time we can make many kinds of different shape of connection.

Please refer to FIG. 2, five sets of the decorative light sets are cooperated with the output of decoding means of first, second decoding means, it can be arranged English letter, for example, W shape, M shape etc.

We have mentioned as above, every circulation light up one of decorative means, if you want light up 2 PCS or 3 PCS even to many PCS, you may change as yo wish according to its arranging of decorative light sets and electric connection method, we will raise one example as 5 PCS in one circulation and send out 10 sets of decorative light sets, among them, the decorative light sets of 1.6; 2.7; 3.8; 4.9; 5.10 are located in one same place, you can get the object of same pursuing, you may light up many of decorative light sets every time, the rest can be deduced accordingly, then, you may reach to the same pursuing, and the object of lighting up many decorative light sets every time. Besides, wiring connection method, you may connect in series directly as two or more than two of decorative light sets, like the above, you can get the same object of pursuing and light up many decorative light set every time.

It should be payed attention that it is relatively high on the power consumption of the wiring connection method, but you can save long wiring material, and you have selected to save power consumption, but you have to use rather much materials and also complicated.

User has to consider its requirement from location and do the suitable selection of layout, and forming more variety of change, in order to attractive a lot of people's attention, also can get the object of decoration.

Obviously, in the light of the above teachings, many modifications in the embodiment of the invention specifically disclosed are possible without departing from the spirit and scope of the appended claim.

What I claim is:

1. A control circuit for controlling the illumination of a plurality of strings of series connected lamp bulbs to generate a decorative light pattern, comprising:

a source of alternating current;

rectifier means for converting alternating current from said source into direct current, said rectifier means having positive and negative output poles through which said direct current is supplied;

a plurality of separate strings of lamps, each of said strings containing a plurality of lamps connected in series, one end of each of said strings being connected in common, said common connection being connected to said positive output pole of said rectifier means;

a plurality of SCRs, equal in number to the number of said plurality of lamp strings, each of said SCR having anode, cathode and gate electrodes, one each of said SCRs having said anode thereof connected to the end opposite said one end of one of said lamp strings, the cathodes of each said SCRs being connected in common to said negative output pole of said rectifier means;

a first oscillator;

a first decoder receiving the output of said first oscillator and providing a first sequence of positive digital output signals, said first decoder having a plurality of output ports, each of said output ports providing a separate one of said positive digital signals of said first sequence;

a second oscillator;

a second decoder receiving the output of said second oscillator and providing a second sequence of positive digital output signals;

a carry-out control receiving said second sequence of positive digital output signals, said carry-out control having a plurality of output ports, each of said carry-out control output ports providing a separate one of said positive digital signals of said second sequence;

a plurality of diodes, each of said diodes having anode and cathode electrodes, each of said diode anodes being connected to a separate one of said output ports of said first decoder and of said carry-out control; and a plurality of trigger circuits, one each for each of said SCRs, each said trigger circuit having a first resistor and a second resistor connected in series, each of the junction points of said first and second resistors being connected the gate electrode of one of said SCRs, the ends of said first resistors opposite said junction points being connected in common to said negative pole of said rectifier means, the end of each said second resistor opposite the junction point thereof with one of said first resistors being connected both to a cathode of a separate one of said diodes connected to said output ports of said first decoder and to a cathode of a separate one of said diodes connected to said output ports of said carry-out control.

* * * * *